US007823543B2

(12) United States Patent
Nomura

(10) Patent No.: US 7,823,543 B2
(45) Date of Patent: Nov. 2, 2010

(54) HEAT EXCHANGING APPARATUS AND SUPERHEATED STEAM GENERATING APPARATUS USING THE SAME

(75) Inventor: Shuzo Nomura, Yokohama (JP)

(73) Assignee: Nomura Reinetsu Yugengaisha, Kanagawa (JP)

( * ) Notice: Subject to any disclaimer, the term of this patent is extended or adjusted under 35 U.S.C. 154(b) by 444 days.

(21) Appl. No.: 11/662,706

(22) PCT Filed: Sep. 15, 2004

(86) PCT No.: PCT/JP2004/013872

§ 371 (c)(1),
(2), (4) Date: Oct. 1, 2007

(87) PCT Pub. No.: WO2006/030526

PCT Pub. Date: Mar. 23, 2006

(65) Prior Publication Data

US 2008/0060795 A1 Mar. 13, 2008

(51) Int. Cl.
*F28F 9/22* (2006.01)

(52) U.S. Cl. ..... 122/31.1; 122/221; 165/159

(58) Field of Classification Search ..... 122/31.1, 122/32, 215, 221, 223; 165/54, 56, 145, 165/159, 143, 144, 132, 139, 172, 173, 175
See application file for complete search history.

(56) References Cited

U.S. PATENT DOCUMENTS 97,865 A * 12/1869 Bourne ..... 122/215
3,760,870 A * 9/1973 Guetlhuber ..... 165/103
3,811,498 A * 5/1974 Ferraro et al. ..... 165/161
4,133,375 A * 1/1979 Ducasse et al. ..... 165/92
4,254,826 A * 3/1981 Adams ..... 165/143
4,450,932 A * 5/1984 Khosropour et al. ..... 181/211
4,621,677 A 11/1986 Suzuki et al.
5,579,836 A * 12/1996 Maruyama ..... 165/175
5,832,994 A * 11/1998 Nomura ..... 165/173
7,055,583 B2 * 6/2006 Filippi et al. ..... 165/145
7,523,603 B2 * 4/2009 Hagen et al. ..... 60/39.55

FOREIGN PATENT DOCUMENTS

JP 59-225294 A 12/1984
JP 60-26115 A 2/1985
JP 2001-41668 A 2/2001
WO WO 03/076059 A1 9/2003

* cited by examiner

*Primary Examiner*—Gregory A Wilson
(74) *Attorney, Agent, or Firm*—Sughrue Mion, PLLC

(57) ABSTRACT

A heat exchange flow passage 21 comprises a plurality of annular flow passages arranged in parallel to each other and also communicated to each other in the circumferential direction, a plurality of inflow ports and a plurality of outflow ports provided in the annular flow passage 24 at positions displaced from each other in the circumferential direction, and a plurality of communication pipes 25 each communicating the inflow port and the outflow port provided in different annular flow passages 24, 24. A fluid feed pipe 22 and a fluid discharge pipe 23 are communicated to this heat exchange flow passage 21 to form a heat exchanging apparatus.

7 Claims, 9 Drawing Sheets

FIG. 5

Air Temperature 29 ° C

Velocity of Flowing Air 18m/sec

Heat Medium Boiling Water

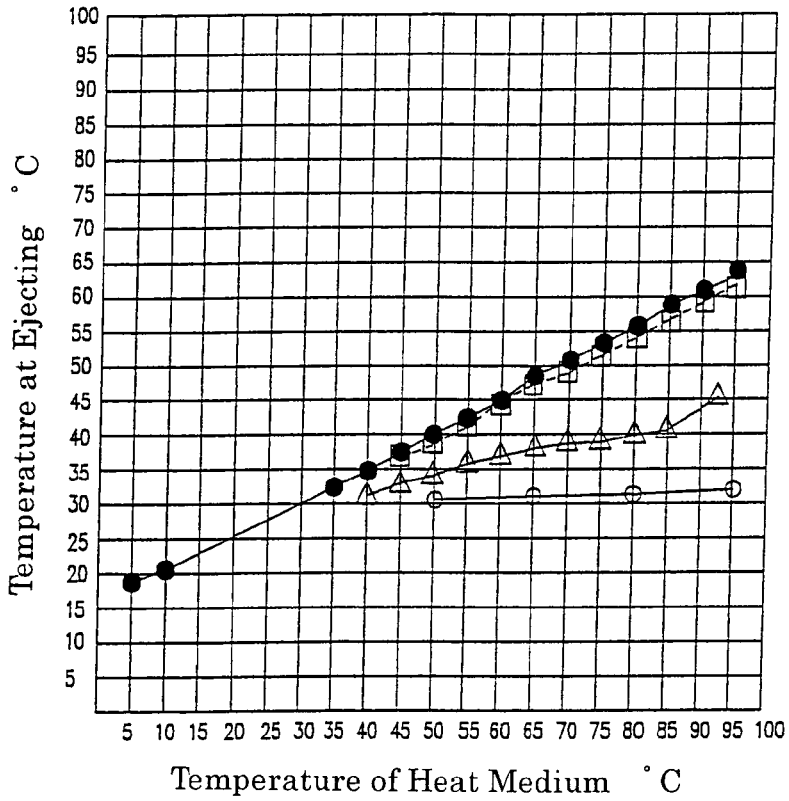

Performance Comparison Table

| Mark | ● | □ | △ | ○ |
|---|---|---|---|---|
| Position of Blower | FIG.3 | FIG.4 | FIG.3 | FIG.4 |
| Volume of Flowing Air | $7M^3$/min | $7M^3$/min | $7M^3$/min | $7M^3$/min |
| Position of Communication Pipe | FIG.1 | FIG.1 | FIG.10 | FIG.10 |
| Step Number of Ring | 2 | 2 | 2 | 2 |
| Area of Heat Exchanging Apparatus | $0.207m^2$ | $0.207m^2$ | $0.207m^2$ | $0.207m^2$ |
| Quantity of Exchanging Heat kcal/h | 4532 | 3380 | 2422 | |
| Heat Transfer Efficiency K kcal/$m^2$h ° C | 440 | 377 | 143 | |

Performance Comparison Table

| Mark | △ | ◎ | □ |
|---|---|---|---|
| Volume of Flowing Steam (L/min) | 60 | 120 | 240 |
| Velocity of Flowing Steam (m/sec) | 23 | 45 | 90 |
| Position of Communication Pipe | FIG.1 | FIG.1 | FIG.1 |
| Step Number of Ring | 8 | 8 | 8 |
| Area of Heat Exchanging Apparatus | $0.041m^2$ | $0.041m^2$ | $0.041m^2$ |
| Quantity of Exchanging Heat kcal/h | 175 | 358 | 716 |
| Heat Transfer Efficiency K $kcal/m^2h$ °C | 70 | 144 | 288 |

HEAT EXCHANGING APPARATUS AND SUPERHEATED STEAM GENERATING APPARATUS USING THE SAME

TECHNICAL FIELD

The present invention relates to a heat exchanging apparatus allowing for size reduction as well as cost reduction and also enabling substantial improvement in heat exchange efficiency and to a superheated steam generating apparatus using the same.

BACKGROUND ART

As a heat exchanging apparatus enabling improvement in heat exchange efficiency by making a flow of a heat transfer fluid collide with another flow of a heat transfer fluid in a heat exchange flow passage, there has been known the heat exchanging apparatus as shown in FIG. 10 (Refer to Japanese Patent laid-open Publication No. HEI 7-294162).

In a heat exchanging apparatus 100 as shown in FIG. 10, however, since annular flow passages 118 are fabricated with pipes, it is difficult to fabricate flow passages with uniform dimensions, which makes it difficult to mass-produce the heat exchanging apparatus, and the cost is inevitably high. Furthermore, because of restrictions over the tube dimensions, sometimes it is impossible to fabricate a flow passage with optical design dimensions, and size reduction of the heat exchanging apparatus 100 is not easy.

When a heat transfer fluid flows from a communication pipe 119 into the annular pipe 118, the heat transfer fluid collides with a turbulent flow of the heat transfer fluid flowing in the annular pipe 118, and a velocity at which the heat transfer fluid collides with an inner wall surface of the annular pipe 118 substantially drops, which makes the heat exchange efficiency disadvantageously lower.

Collision of the heat transfer fluid with the inner wall surface of the annular pipe 118 occurs only when the heat transfer fluid flows into the annular pipe 118, and the collision does not occur when the heat transfer fluid flows out, and thus the heat exchange effect caused by collision of the heat transfer fluid with the inner wall surface of the annular pipe 118 occurs only once in one annular pipe 118. Therefore, for improving the heat exchange efficiency, it is necessary to increase a cross section of the annular pipe 118, or to increase the number of annular pipes 118.

Furthermore, in the heat exchanging apparatus based on the conventional exchanging apparatus, there is no specific design for a mounting angle of the communication pipe 119 to an internal surface of the annular pipe 118, nor for a form of the internal surface of the annular pipe 118 for maximizing the heat exchange efficiency during the collision.

In an application of the heat exchanging apparatus 100 in which a heat transfer fluid is flown into a heat exchange flow passage 110 by sucking air therein with a blower or the like, the heat transfer fluid flows without colliding with the internal surface of the annular pipe 118, so that the heat exchange efficiency in the heat exchanging apparatus 100 substantially drops. Because of the structure, the blower is required to be installed in front of the heat exchange flow passage 110.

On the other hand, there has been known the method for generating superheated steam as disclosed in Japanese Patent Laid-Open Publication No. HEI 10-337491, and in the method, an increase in temperature of steam is produced by sucking heated gas from an inflow port with an ejector blowing out steam at an ultrahigh speed from a nozzle thereof.

With the method for generating superheated steam, however, it is possible to obtain superheated steam flowing at a high speed, but sometimes clean superheated steam can not be obtained because of characteristics of the heated gas, and furthermore the gas is mixed with steam to form a mixture, and also in this case, highly pure superheated steam can not be obtained.

Especially, when a flame or a heated discharge gas is used, it is impossible to obtain superheated steam having ultrahigh purity required for cleaning, for instance, semiconductor wafers, and therefore the method can not be employed for cleaning. Furthermore, the method can not be employed in a clean room where use of a flame is inhibited.

DISCLOSURE OF INVENTION

The present invention was made to solve the problems in the conventional technology as described above, and an object of the present invention is to provide a heat exchanging apparatus allowing for size reduction as well as cost reduction and enabling substantial improvement in heat exchange efficiency.

Another object of the present invention is to provide a superheated steam generating apparatus that can generate superheated steam flowing at a high speed and having high purity by using the heat exchanging apparatus.

To achieve the objects described above, a heat exchanging apparatus according to the present invention comprises a heat exchange flow passage including a plurality of annular flow passages provided in parallel to each other along a circumferential direction and also communicated to each other, a plurality of inflow ports and outflow ports which are formed in each of the annular flow passage and provided at positions displaced from each other in the circumferential direction, and a plurality of communication pipes communicating the inflow ports and outflow ports provided in different annular flow passages; and a feed pipe and an discharge pipe which are communication to the heat exchange flow passage.

To achieve the objects of the present invention described above, an superheated steam generating apparatus according to the present invention comprises a steam feeder for feeding steam, a heat source for heating the steam, and the heat exchanging apparatus in which the heat steam is flown for heat exchange.

BRIEF DESCRIPTION OF DRAWINGS

FIG. 5 provides a performance characteristic graph and a performance comparison table prepared based on results of the performance tests carried out in the general configurations shown in FIG. 3 and FIG. 4 respectively using the heat exchanging apparatus according to the present invention and a heat exchanging apparatus based on the conventional technology;

BEST MODE FOR CARRYING OUT THE INVENTION

A heat exchanging apparatus according to the present invention and a superheated steam generating apparatus using the same are described in detail below with reference to the drawings.

Figure 1:
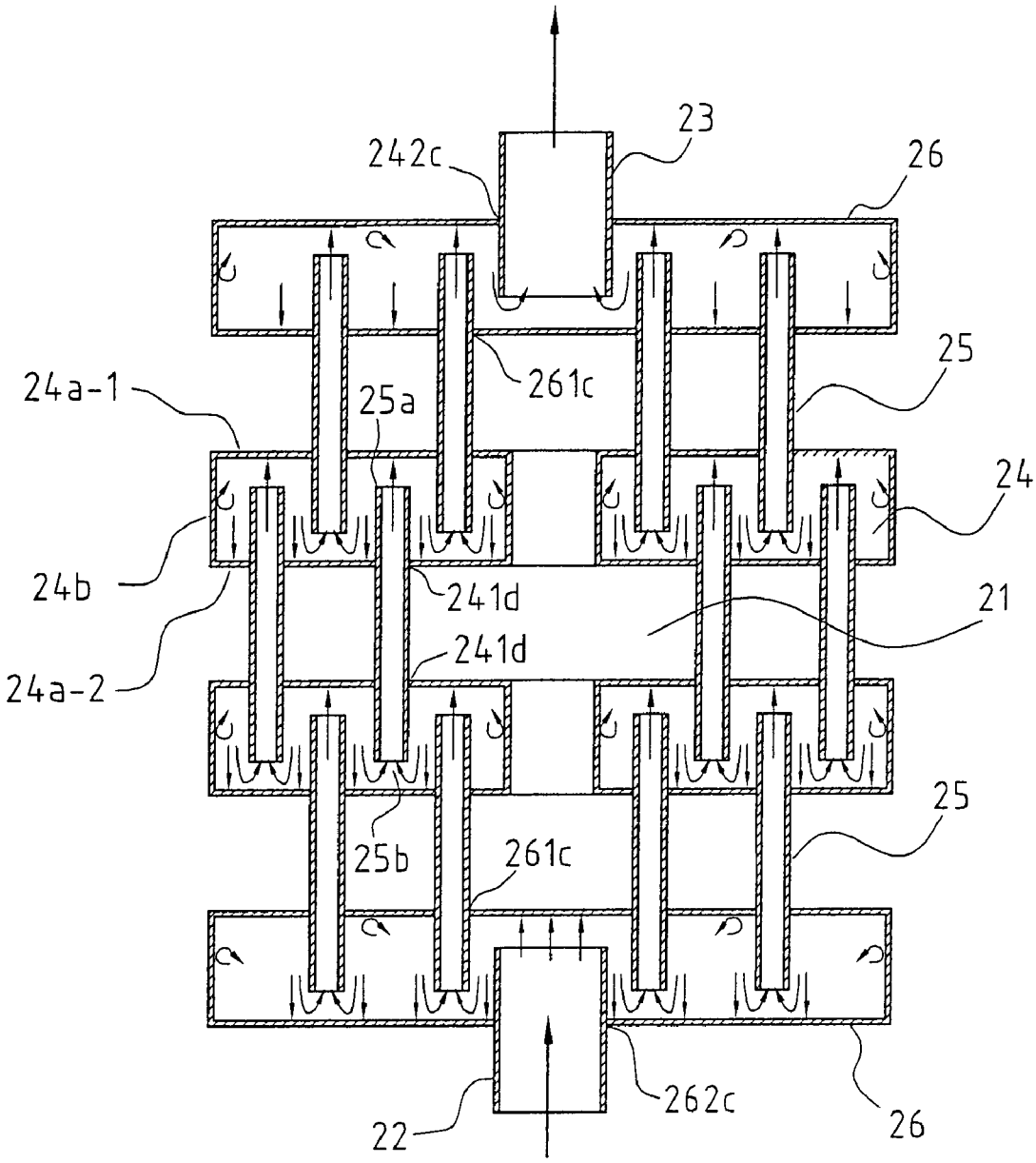
FIG. 1 is a longitudinal cross-sectional view illustrating a heat exchanging apparatus according to an embodiment of the present invention.
Figure 2:
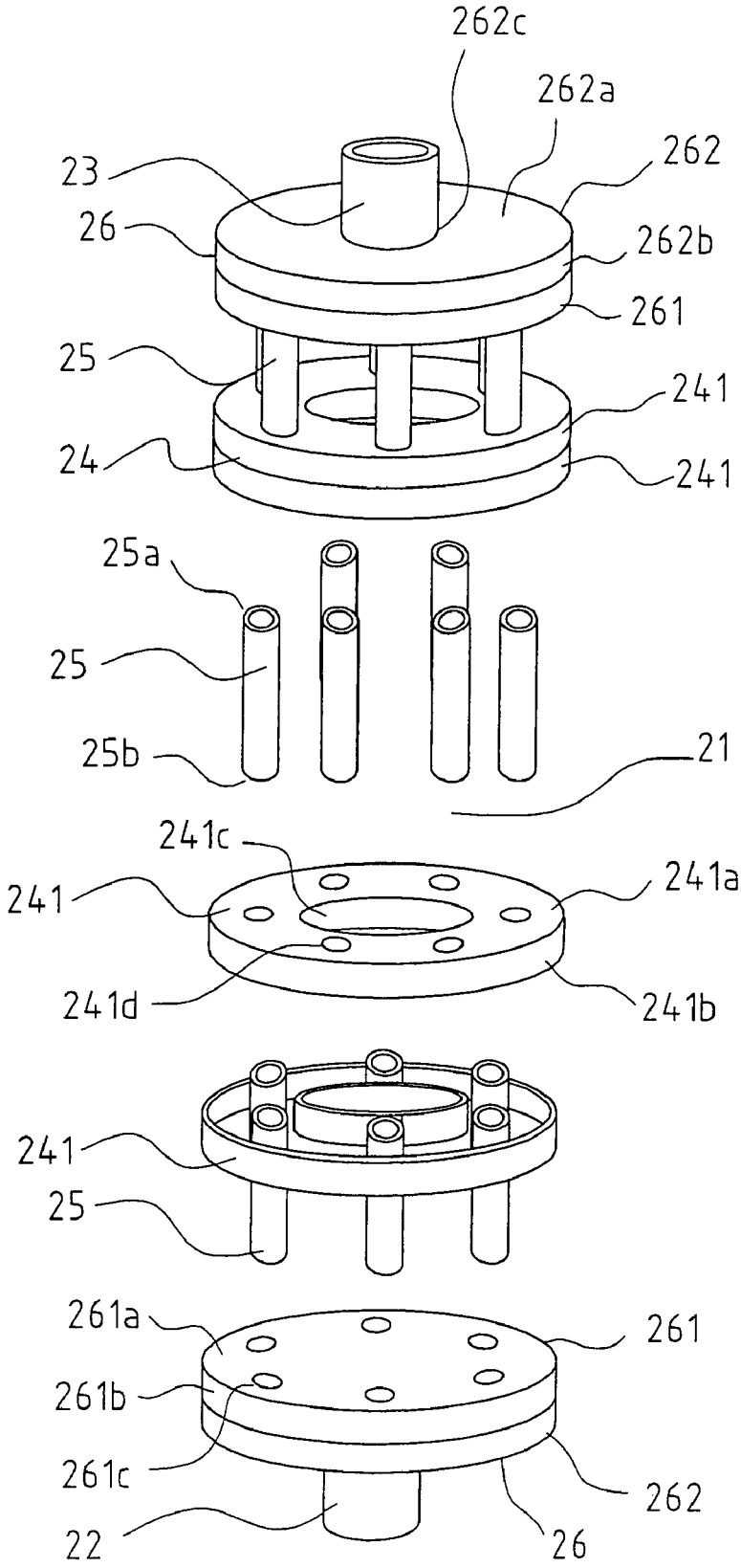
FIG. 2 is an exploded perspective view illustrating a key section of the heat exchanging apparatus shown in FIG. 1.

A heat exchanging apparatus 1 according to the present invention comprises a heat exchange flow passage 21 including a plurality of annular flow passages 24 provided in parallel to and communicated to each other in the circumferential direction, a plurality of inflow ports and outflow ports formed in the annular flow passages 24 at positions displaced in the circumferential direction, and a plurality of communication pipes 25 each communicating the inflow port and the outflow port provided in the different flow passages 24 and 25; a feed pipe 22; and a discharge pipe 23, for a heat transfer fluid communicated to the heat exchange flow passage 21, as shown in FIG. 1 and FIG. 2.

The annular flow passage 24 is formed by providing annular flow passage members 241, 241 having the same form and dimensions at positions opposite to each other, contacting and, for instance, welding edge faces of the members 241, 241 to each other.

The annular flow passage member 241 includes an annular flat surface portion 241*a*, an outer peripheral portion 241*b*, and an inner peripheral portion 241*c*, and communication holes 241*d* are provided on the annular flat surface portion 241*a* at positions equally spaced in the circumferential direction. The annular flow passage member 241 is formed by pressing a metal plate or by casting a melted metal.

When forming the annular flow passage 24 by welding the annular flow passage members 241, 241 to each other, as shown in FIG. 2, a communication hole 241*d* of the annular flow passage member 241 is displaced from a communication hole 241*d* of another annular flow passage member 241 in the circumferential direction, and then the annular flow passage members 241 are adhered to each other, for instance, by welding.

The communication pipe 25 is fabricated by cutting a metallic pipe having a prespecified diameter to pieces each having an appropriate length, and is inserted into the communication hole 241*d* provided on the annular flow passage member 241. Then, in the state where the communication pipe 25 protrudes from an inner wall surface in the annular flat surface portion 241*a* of the annular flow passage member 241, the outer peripheral surface of the communication pipe 25 and the communication hole 241*d* are adhered to each other, for instance, by welding at a position where the outer peripheral surface contacts the communication hole 241*d*.

Then the annular flow passage members 241, 241 are adhered to each other to form the annular flow passage 24, and the communication pipes 25, 25 are inserted into the annular flow passage member 241. By repeating the operation described above, it is possible to form a heat exchange flow passage 21 in which a plurality of annular flow passages 24 are provided in parallel to each other as shown in FIG. 1.

Storage tanks 26, 26 are provided at both ends of the heat exchange flow passage 21 communicated to the feed pipe 22 and the discharge pipe 23 for a heat transfer fluid.

The storage tank 26 is formed by providing storage tank members 261, 262 at positions opposite to each other, contacting and, for instance, welding edge faces of the members 261, 262 to each other.

The storage tank member 261 includes a circular flat portion 261*a* and an outer peripheral portion 261*b*, and communication holes 261*c* are provided on the circular flat portion 261*a* at positions equally spaced in the circumferential direction. On the other hand, the storage tank member 262 includes a circular flat portion 262*a* and an outer peripheral portion 262*b*, and communication hole 262*c* is provided on the central part of the circular flat portion 262*a*. The storage tank members 261, 262 are formed by pressing a metal plate or by casting a melted metal. A fluid feed pipe 22 and a fluid discharge pipe 23 are fabricated by cutting a metallic pipe having a prespecified diameter to pieces each having an appropriate length, and are inserted into the communication holes 262*c* provided on the storage tank member 262. Then, in the state where these pipes protrude from inner wall surfaces of the circular flat portions 262*a* of the storage tank members 262, the outer peripheral surfaces of these pipes and the communication holes 262*c* are adhered to each other, for instance, by welding at a position where the outer peripheral surfaces contact the communication holes 262*c*.

Communication pipes 25 are inserted into the communication holes 261*c* provided on the storage tank members 261, and in the state where these pipes protrude from the inner wall surfaces of the circular flat portions 261*a* of the storage tank members 261, the outer peripheral surfaces of these pipes and the communication holes 261*c* are adhered to each other, for instance, by welding at a position where the outer peripheral surfaces contact the communication holes 261*c*.

As described above, the heat exchanging apparatus 1 according to the present invention is formed by making the fluid feed pipe 22 and the fluid discharge pipe 23 communicate with each other through the storage tanks 26, 26 at both ends of the heat exchange flow passage 21.

When forming the heat exchanging apparatus 1, tip faces 25*a* of the communication pipes 25 protruding from the inner wall surfaces of the annular flat surface portions 241*a* of the annular flow passage members 241 are set at positions close to the inner wall surfaces of the annular flat surface portions 241*a* of the annular flow passage members 241 and not reducing the flow rate of the fluid flowing through communication pipes 25. The proximity distance is preferably set in a range from $0.1 \times S/L$ to $10 \times S/L$, wherein S denotes a cross-sectional area of the communication pipe 25 and L denotes an outer circumferential length thereof. A central axis of the communication pipe 25 and the inner wall surface of the annular flat surface portion 241*a* of the annular flow passage member 241 are arranged to be approximately orthogonal to each other.

As described above, since, in the heat exchanging apparatus 1 according to the present invention, the annular flow passage 24 is fabricated, without using pipes, by providing the annular flow passage members 241, 241 having the same form and dimensions at positions opposite to each other, and, for instance, welding edge faces of the members 241, 241 to each other, the annular flow passage 24 having exact dimensions is easily fabricated only by adjusting positions of the communication holes 241*d* in the circumferential direction and combining the members.

Further, by forming the annular flow passage member 241 by pressing or by casting, the annular flow passage 24 having an exact form and dimensions can be easily fabricated, and therefore the annular flow passage 24 with a minimum number of parts can be fabricated in bulk with at reduced costs. At the same time, as shown in FIG. 1, the communication pipes 25 can easily thrust into the annular flow passage 24.

As shown in FIG. 1, since, in the heat exchanging apparatus 1 according to the present invention, the tip faces 25*a* of the communication pipes 25 are brought at positions close to the inner wall surface 24*a*-1 of the annular flow passage 24 and not reducing the flow rate of the heat transfer fluid, the heat transfer fluid flowing thereinto collide with the inner wall surface 24*a*-1 almost without being affected by the heat transfer fluid flowing in the annular flow passage 24 in a turbulent state, that is, almost without reducing the flow rate, and therefore the heat exchange efficiency significantly increases.

As shown in FIG. 1, since the central axis of the communication pipe 25 and the inner wall surface 24*a* of the annular flow passage 24 are arranged to be approximately orthogonal to each other, all the heat transfer fluids collide with the inner wall surface 24*a*-1 of the annular flow passage 24 in the same state, and therefore the heat exchange efficiency can be held stably.

Furthermore, by arranging the rear edge faces 25*b* of the communication pipe 25 on the outlet side at positions close to the inner wall surface 24*a*-2 of the annular flow passage 24 and not reducing the flow rate of the heat transfer fluid, the heat transfer fluid which collides with the inner wall surface 24*a*-1 of the annular flow passage 24 collides, in a turbulent state, with the inner wall surface 24*a*-2 of the annular flow passage 24 on the opposite side to effect heat exchange, and therefore the heat exchange can be carried out on inner wall surface24*a*-1, 24*a*-2 on both sides of the annular flow passage 24, and the heat exchange efficiency further increases.

In addition, since the heat transfer fluid flowing through the annular flow passage 24 in a turbulent state is also not affected by the heat transfer fluid flowing into or out, the heat exchange efficiency on the side wall surface 24*b* of the annular flow passage 24 also increases.

Since the heat transfer fluid flows out from the outlet of the communication pipe 25 and into the next annular flow passage 24 and can achieve the same action, even the same size of the heat exchange flow passage 21 can subject a greater amount of the heat transfer fluid to heat exchange without enlarging the passage size. Even when the number of annular flow passages 24 increased, the flow rate of the heat transfer fluid is hardly reduced, and the heat exchange can be carried out without reducing the flow rate of the heat transfer fluid flowing at a high speed.

In the heat exchanging apparatus 1 improved as described above, a preferable excellent heat exchange can be carried out even by a method of arranging a blower on the outlet side of a heat exchange flow passage 21 and sucking a heat transfer fluid, and therefore the heat exchanging apparatus 1 can be used in a wide range.

For example, since a large amount of fluid can be heat-exchanged efficiently with the heat exchanging apparatus 1 having a small size, the heat exchanging apparatus 1 is optimal as a heat pump type air conditioner for heat-exchanging a large amount of air.

[Performance Test of Heat Exchanging Apparatus]

Figure 3:
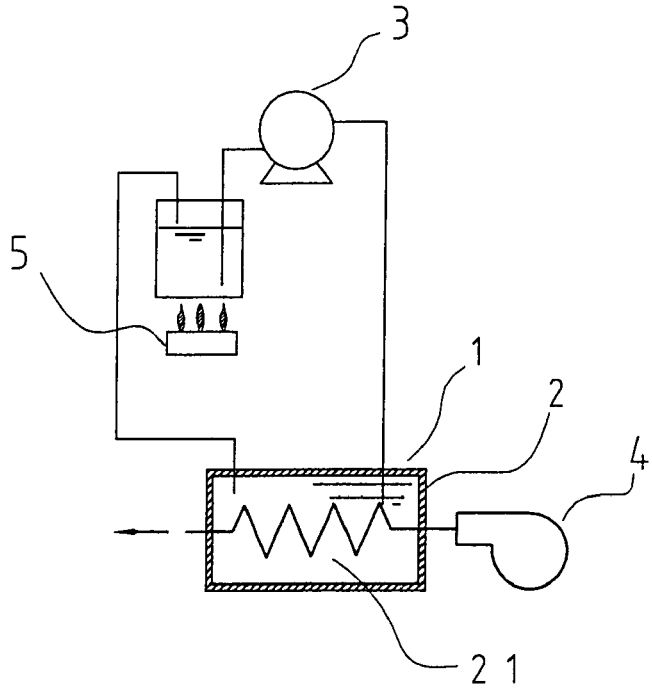
FIG. 3 is a general block diagram illustrating a heat exchanging apparatus performance test carried out by providing a blower in the feeding side of a heat exchange flow passage and circulating air in the heat exchange flow passage with the blower.
Figure 4:
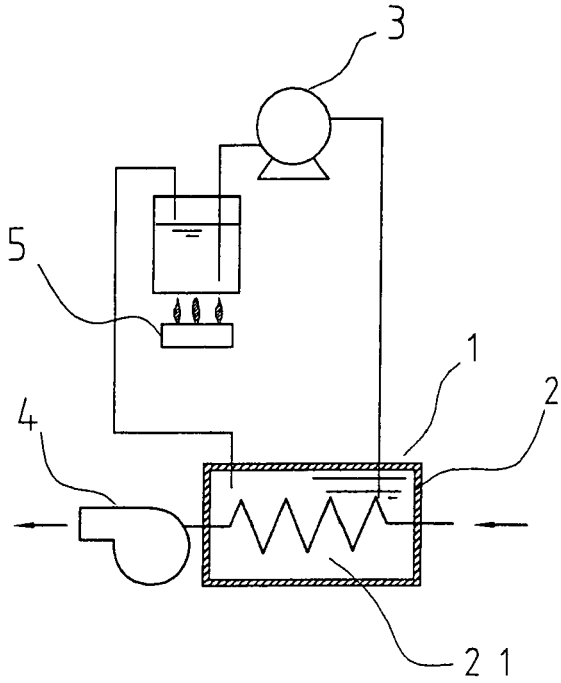
FIG. 4 is a general block diagram illustrating a heat exchanging apparatus performance test carried out by providing a blower in the discharging side of a heat exchange flow passage and circulating air in the heat exchange flow passage with the blower.

Then, testing for performance of the heat exchange flow passage 21 was carried out by arranging the heat exchange flow passage 21 in a container 2 in which heated water can be filled in, supplying heat by circulating the heated water, and also feeding air with the blower 4 as shown in FIG. 3 and FIG. 4.

The heat exchange flow passage 21 used in the testing has two annular flow passages 24 each having an outer diameter of 200 mm and the blower 4 capable of always feeding supplying air at a feed rate of 7 $m^3$/min. A gas burner 6 is used to reheat the water after heat is deprived of by the heat exchange flow passage 21, and the heated water is always supplied by circulating the heated water with a pump 3.

As shown in FIG. 4, in the method in which air is sucked by the blower 4 provided in the outflow port side of the heat exchange flow passage 21, in a case were the communication pipe 119 does not protrude into the annular flow passage 118 like in the conventional technology, the sucked air does not collide with an inner wall surface of the annular flow passage 118, so that the sufficient performance of the heat exchanging apparatus can not be achieved.

However, in the heat exchange flow passage 21 according to the present invention, in which the communication pipe 25 protrudes into the annular flow passage 24, even when air is supplied as shown in FIG. 3, or even when air is sucked as shown in FIG. 4, excellent heat exchange performance is achieved, which enables use of the heat exchange in a substantially wide area. A result of the testing shows that the heat exchange performance of 4532 Kcal/h (5.3 KW/h) can be achieved, and the heat exchanging apparatus can sufficiently be used for a small size heat pump for domestic use.

FIG. 5 provides a performance characteristic graph and a performance comparison table prepared based on results of the performance tests for the heat exchanging apparatus 1 according to the present invention and the heat exchanging apparatus 100 disclosed in Japanese Patent Laid-Open Publication No. HEI 7-294162 performed under the configurations shown in FIG. 3 and FIG. 4 respectively. The two exchanging apparatus has the same form, but a tip 25*a* of the communication pipe 25 is set at a position close to an inner wall surface of the annular flow passage 24 yet not throttling a flow of the heat transfer fluid in the heat exchanging apparatus 1, while the communication pipe 119 does not protrudes into inside of the annular flow passage 118. In the heat exchanging apparatus 100 described in Japanese Patent Laid-Open Publication No. HEI 7-294162 carried out as shown in FIG. 4, sufficient numeral data was not obtained, so that the result is not shown.

Figure 8:
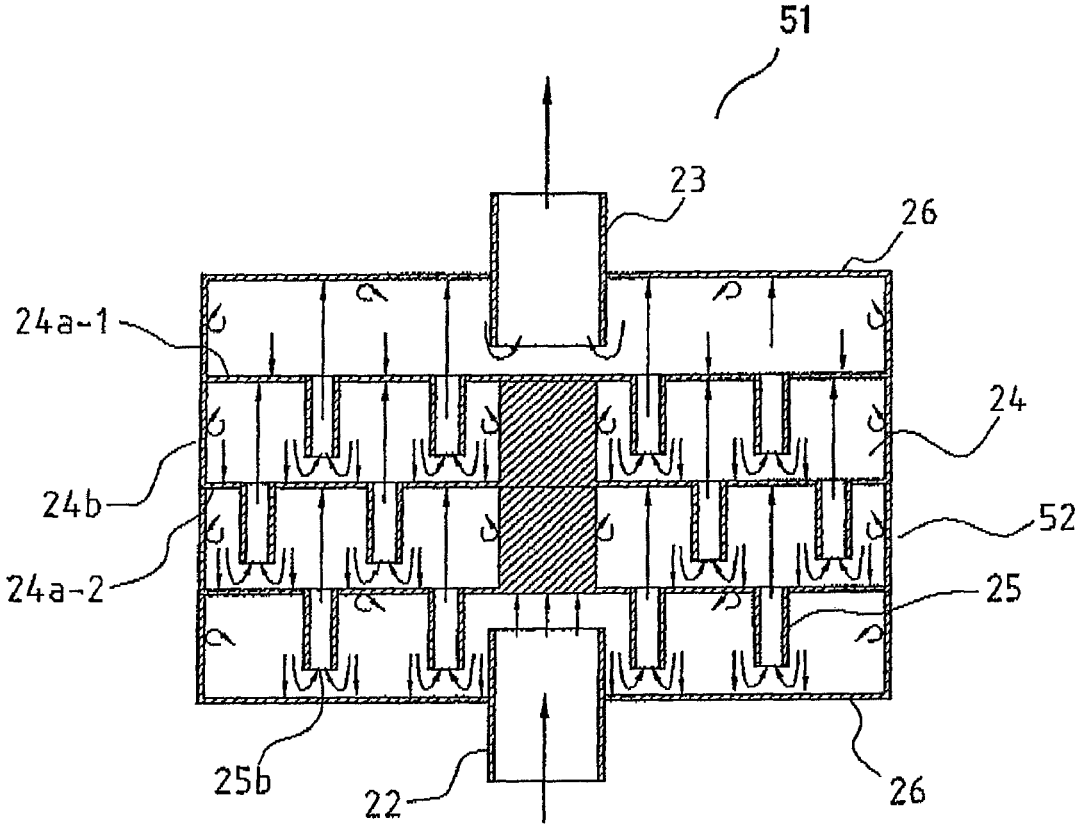
FIG. 8 is a longitudinal cross-sectional view illustrating a key section of the heat exchanging apparatus according to another embodiment of the present invention.
Figure 9:
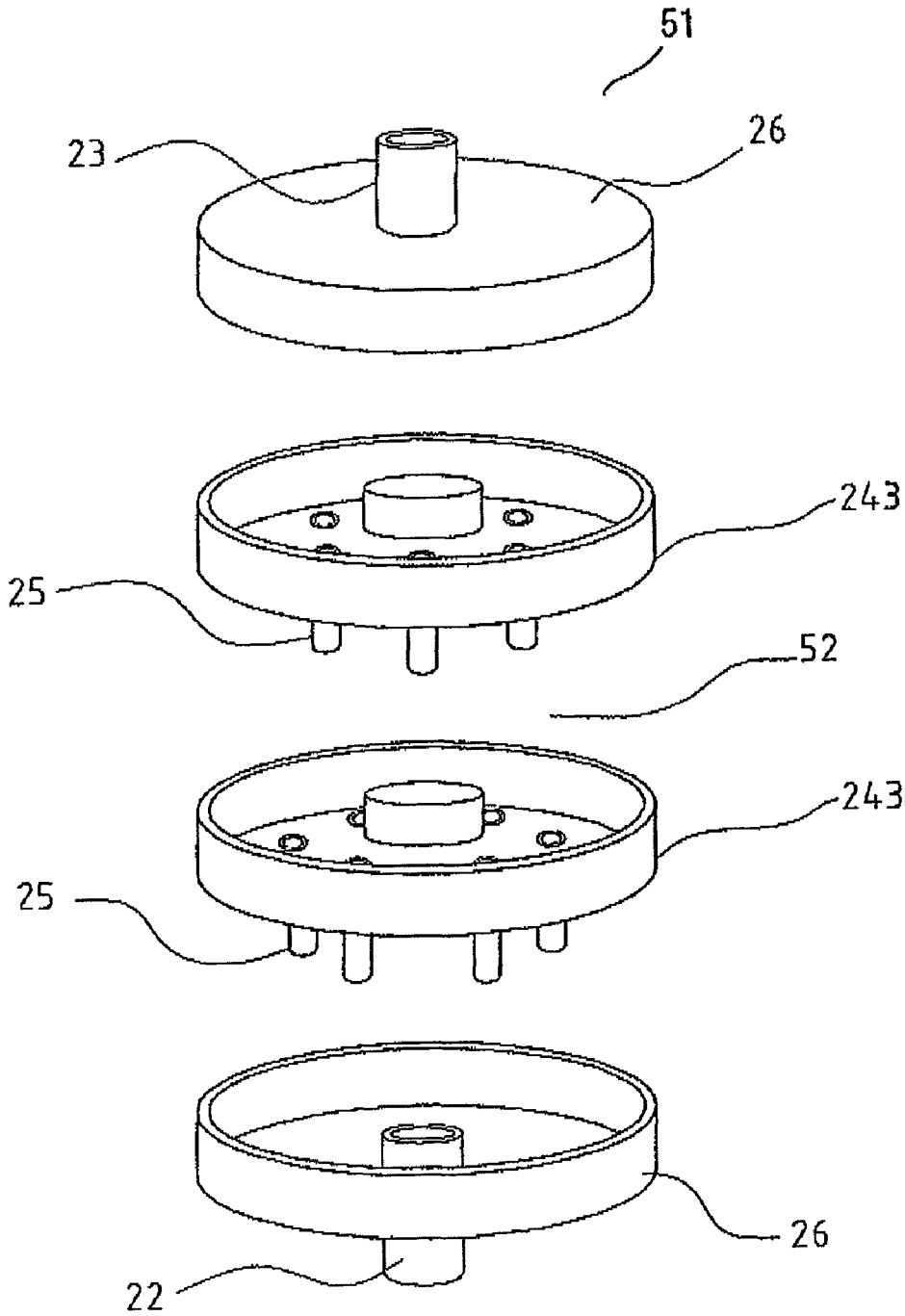
FIG. 9 is an exploded perspective view of a key section of the heat exchanging apparatus shown in FIG. 8.
Figure 10:
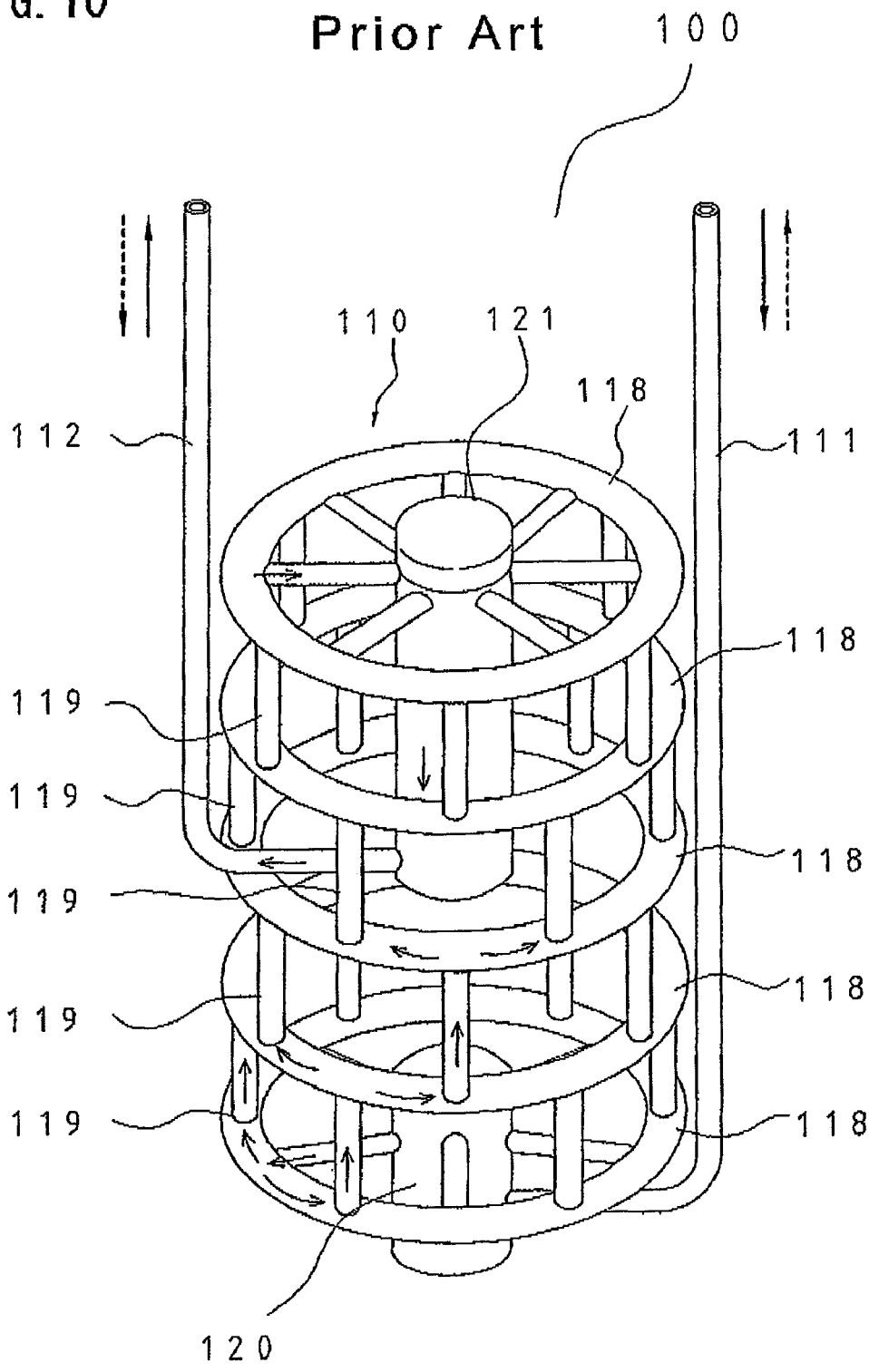
FIG. 10 Prior Art
FIG. 10 is a perspective view illustrating a key section of a heat exchanging apparatus based on the conventional technology.

The heat exchanging apparatus according to the present invention may have the configuration of the heat exchanging apparatus 51 shown in FIG. 8 and FIG. 9.

The heat exchanging apparatus 51 is formed by arranging a plurality of annular flow passages 24, 24 at positions close and in parallel to each other, providing a communication hole functioning as a inflow port and an outflow port for the adjoining annular flow passages 24, adhering a tip end surface of the communication pipe 25 to the communication hole with the communication pipe 25 protruding into only one of the adjoining annular flow passages to provide a heat exchanging apparatus flow passage 52. Other portions of the configuration are substantially the same as those of the heat exchanging apparatus 1 described above.

In the heat exchanging apparatus 51, the annular flow passage 24 is formed by serially arranging annular flow passage members 243, 243 having the same form at positions close to each other, while an end face of the communication pipe 25 is adhered to the communication hole of the annular flow passage member 243, and therefore size of the heat exchange flow passage 52 can substantially be reduced. In addition, the number of components for the heat exchange flow passage 52 can substantially be reduced, and the heat exchange flow passage 52 can easily be fabricated with the cost substantially reduced.

In the heat exchanging apparatus 51, as shown in FIG. 8, a tip end surface 25*a* of the communication pipe 25 does not protrude into the annular flow passage 24, so that the tip end surface 25*a* is not close to an inner wall surface 24*a*-1 of the annular flow passage 24. Because of the structure, an introduced heat transfer fluid is affected by another turbulent flow of the heat transfer fluid, and the flow velocity is slightly lowered before the heat transfer fluid collides with the inner wall surface 24*a*-1, and therefore the heat exchange efficiency becomes slightly lower as compared to that in the heat exchanging apparatus 1.

By applying the heat exchanging apparatus 1 or 51, it is possible to configure a superheated stream generating apparatus used for cleaning wafers 11 or the like requiring purity enough to be used in a semiconductor or the like by feeding steam flowing at a high velocity from a boiler provided outside through, a piping 13 to the heat exchange flow passage 21 according to the present invention provided in a clean room, and heating the stream with an electric heater 6 without reducing the high flowing velocity to generate superheated stream 12 which is clean and flows at a high velocity.

The heat exchanging apparatus 1 in the superheated stream generating apparatus according to the present invention comprises a heat exchange flow passage 21, a feed pipe 22 for feeding a heat transfer medium to the heat exchange flow passage 21, and a discharge pipe 23 for discharging the heat transfer medium from the heat exchange flow passage 21, and the heat exchange flow passage 21 comprises the annular flow passage 24 and the communication pipe 25. The superheated stream generating apparatus according to this embodiment has 8 annular flow passages 24.

The heat exchange flow passage 21 may be formed with any material capable of enduring a temperature of 100° C. or more such as, an STPT pipe, an STB pipe, an STBA pipe, and an SUS pipe or with such materials as aluminum, copper, and stainless steel.

The heat exchange flow passage 21 is accommodated within the container 2, and the container 2 is made of a heat-insulating material for ensuring high thermal efficiency. The container itself may be made of a heat-insulating material, or an inner or outer surface of the container 2 made of other material may be coated with a heat-insulating material.

Various types of heat generating devices such as a burner using oil, natural gas, propane or the like as a fuel or an electric heater may be used as a heat source for heating the heat exchange flow passage 21. In this embodiment, a power-saving lamp heater 6 is used.

A piping 13 connected to a boiler with a decompression valve 9 and a flow rate adjusting valve 10 provided thereon is connected to the feed pipe 22 of the heat exchanging apparatus 2.

The discharge pipe 23 of the heat exchanging apparatus 1 is communicated via a piping 14 to the user side. A temperature sensor 8 is mounted to the piping 14, and an output from the temperature sensor 8 is input into a temperature controller 7. The temperature controller 7 controls power consumption in the lamp heater 6 according to a signal from the temperature sensor 8, and a temperature of generated superheated steam is controlled by setting a temperature of the lamp heater 6 to a specified level.

The supplied steam flows through a flow rate adjusting valve at a high velocity and is decompressed by the decompression valve 9, and is supplied to the heat exchange flow passage 21 through the piping 13. The steam is subjected to heat exchange in the heat exchange flow passage 21, and the superheated steam having a high flow velocity and heated therein is supplied to the user through the piping 14.

When it is necessary to adjust a flow velocity of the superheated steam in the user side, a required flow velocity can be obtained by adjusting a pressure of steam supplied from a boiler with the decompression valve 9 attached to the piping 13 in the inlet port side, or by adjusting an opening degree of the flow rate adjusting valve 10.

When it is necessary to adjust a temperature of the superheated steam 12 in the user side, temperature control for the generated superheated stream 12 flowing at a high velocity is performed by adjusting an electric power consumed in the lamp heater 6 with the temperature controller 7 according to an signal from the temperature sensor 8 attached to the piping 14 in the outlet port side.

The temperature controller 7 turns OFF power when a signal from the temperature sensor 8 indicates that the temperature has reached the upper limit, and turns ON power when the signal indicates that the temperature has dropped to the lower limit, and thus the temperature is always kept at a constant level. Alternatively it is also possible to always keep the temperature at a constant level by adjusting the voltage at a constant value with a thyristor.

When steam from a boiler or the like is introduced at a high flow velocity into the heat exchanging apparatus flow passage 21 within the container 2 having the configuration as described above and the steam is heated with the lamp heater 6 or the like, the steam increases the flow velocity in the communication pipe 25 branched to several flow passages therein and collides with the inner wall surface 24*a*-1 of the annular flow passage 24 of the heat exchange flow passage 21 at a high flow velocity. The steam colliding with the inner wall surface at a high velocity are substantially affected by the wall surface 24*a*-1 and efficiently exchanges heat therewith.

When the communication pipe 25 is brought to a position close to the inner wall surface 24*a*-1 of the annular flow passage 24 but not throttling a flow rate of steam, the introduced steam collides with the wall surface 24*a*-1 without being substantially affected by a turbulent flow in the annular flow passage 24, namely without substantially reducing the flow velocity, so that the heat exchange efficiency is further improved.

The higher flatness of the inner wall surface 24*a*-1 of the annular flow passage 24 is, the wider range of the inner wall surface affects the steam in collision, so that the heat exchange efficiency becomes higher.

Furthermore, the steam introduced into the annular flow passage 24 exchanges heat with the inner wall surface 24*a*-1 of the annular flow passage 24 to form a turbulent flow and then flows toward the next communication pipes 25. In this step, the heat transfer fluid collides with a side wall surface 24*b* of the annular flow passage 24 of the heat exchanging apparatus and is substantially affected by the side wall surface 24*b* to achieve efficient heat exchange.

Then the heat-exchanged steam flows at a high velocity toward an inlet port of the next communication pipe 25, but with the configuration in which the communication pipe 25 in the inlet port side is brought to a position close to an inner wall surface 24*a*-2 of the annular flow passage 24 but not throttling a flow of steam, because the inlet port of the communication pipe 25 is close to the inner wall surface 24*a*-2 of the annular flow passage 24 in the opposite side, the heat transfer fluid in the annular flow passage 24 collides also with the inner wall surface 24*a*-2 of the annular flow passage 24 in the opposite side to effect heat exchange therewith, so that the heat exchange efficiency is further improved. As described above, the higher flatness of the inner wall surface 24*a*-2 of the annular flow passage 24 is, the wider range of the inner wall surface affects the steam in collision, so that the heat exchange efficiency becomes higher.

Thus the heat transfer fluid exchanges heat with the side wall surface 24*b* of the annular flow passage 24 as well as with the two inner wall surfaces 24*a*-1, 24*a*-2 of the annular flow passage 24, so that the heat exchange efficiency is substantially improved.

Since steam is little affected by a turbulent flow of steam within the annular flow passage 24 when the steam flows in and out, the flow velocity is little reduced even when there are a number of annular flow passages 24, and therefore superheated steam having a high flow velocity can be generated. The steam having been subjected to heat exchange is sent from the inlet port of the communication pipe 25 to the next annular flow passage 24, and achieves the same heat exchange effect there.

[Performance Test of the Superheated Stream Generating Apparatus]

Figure 6:
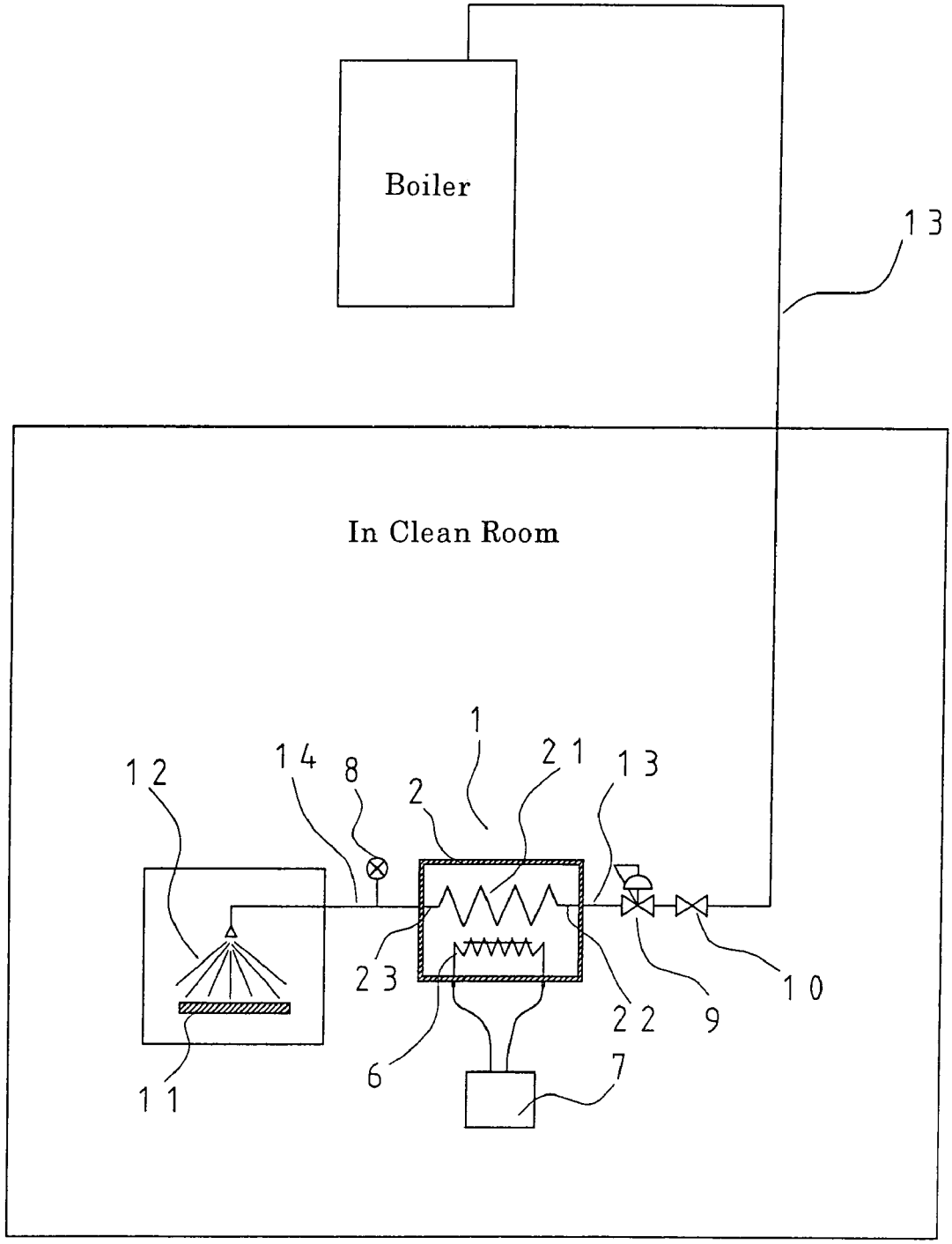
FIG. 6 is a general block diagram illustrating a configuration in which the superheated steam generating apparatus according to the present invention is applied to an apparatus for cleaning semiconductor wafers or the like in a clean room.
Figure 7:
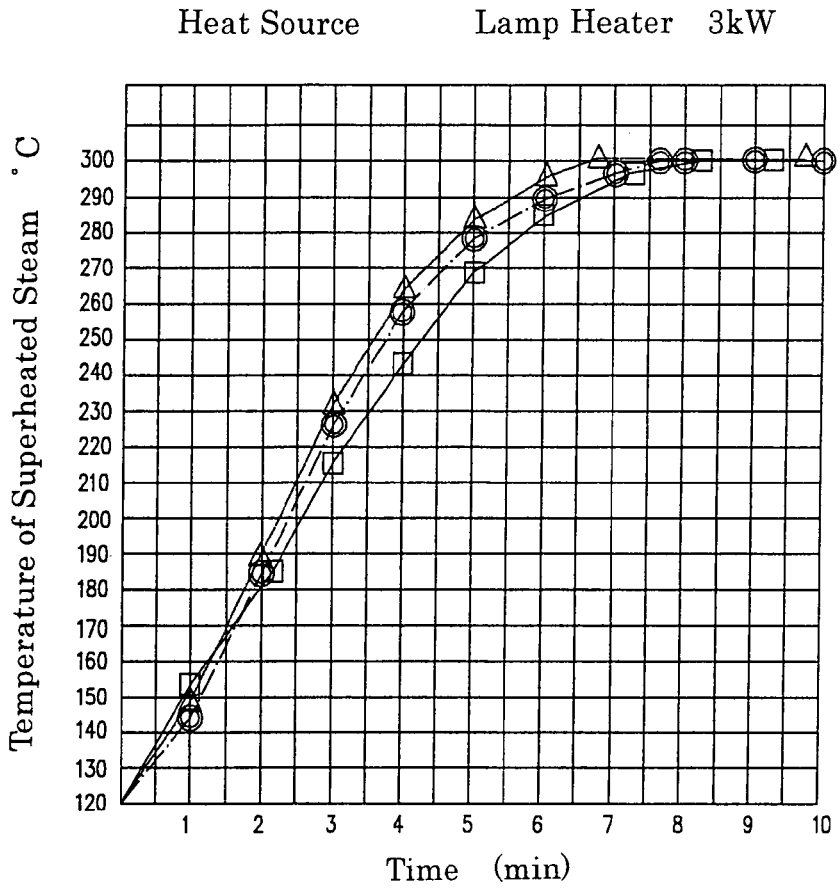
FIG. 7 provides a performance characteristic graph and a performance comparison table prepared based on results of the performance test of the superheated steam generating apparatus according to the present invention carried out by using an electric heater.

As a result of performance test of the superheated stream generating apparatus having the configuration as shown in FIG. 6, it has been found that the performances as shown in FIG. 7 could be achieved.

When steam having the temperature of 120° C. was supplied at a flow rate of 240 L/min and heated, superheated steam with the flow velocity of 90 m/sec or more could be generated, and the superheated steam having the temperature of 200° C. and the flow velocity in the range from 10 to 30 m/sec required for wafer cleaning could easily be generated.

In a degreasing test of grease deposited on a wafer, an excellent cleaning effect could be obtained only by supplying the superheated steam.

As described above, in the superheated steam generating apparatus according to the present invention, even when it is required to downsize the heat exchange flow passage 21 and form a plurality of annular flow passage 24 to be set in the clean room, a flow rate of the superheated steam flowing out is hardly reduced, and a clean superheated steam 12 flowing at a high velocity required for cleaning can continuously be generated.

Conventionally, organic solvents such as fluoride, IPA are used for cleaning semiconductor wafers. However, sophisticated techniques are required for detoxification of the organic solvents after cleaning, and the treatment cost is expensive. Additionally, harmful environmental effects by the organic solvents have caused serious social issues.

In the superheated steam generating apparatus according to the present invention, however, the clean superheated steam 12 flowing at a high velocity can be generated, and the semiconductor wafers 11, precision parts or the like can be cleaned by reheating clean steam flowing at a high velocity obtained from a boiler or the like almost without reducing the flow rate required for cleaning. Since the power-saving electric heater 6 can be used as a heat source, superheated steam generating apparatus according to the present invention can be applied to a clean room requiring high degree of cleanliness.

Since, in cleaning, only steam is required and the organic solvents such as fluoride, IPA or the like are not required, it is not necessary to take into consideration the posttreatment of the organic solvents or the like contaminating the environment.

When a temperature of the superheated steam is set at 170° C. or more, the cleaned material can be dried as it is due to the inversion temperature characteristic of the superheated steam, and therefore a drying process can be omitted. Thus, the IPA or the like used in the drying process is also not required, and furthermore the posttreatment of the organic solvents or the like contaminating the environment is not required.

As described above, since only steam not contaminating the environment is used for cleaning, cleaning can be performed without giving any damage to the environment. Furthermore, since a cleaning process and a drying process can be carried out simultaneously, it is possible to simplify the process and reduce the manufacturing cost concurrently.

Additionally, when the flow rate is adjusted, for instance, to a range from 5 to 10 m/sec, the superheated steam generating apparatus according to the present invention can be applied also to cooking of foods (thawing, baking, thawing and baking at the same time, heating, sterilization, steaming, smothering, roasting, drying).

Further, since the superheated steam generating apparatus according to the present invention is suitable also for drying at a high temperature due to the inversion temperature (170° C.) property of the high temperature superheated steam, the apparatus can be applied to drying of parts, garbage or the like.

The invention claimed is:

1. A heat exchanging apparatus comprising a heat exchange flow passage including a plurality of annular flow passages arranged in parallel to and communicated in the circumferential direction to each other, a plurality of inflow ports and a plurality of outflow ports provided in each of the annular flow passages at positions displaced from each other in the circumferential direction, and a plurality of communication pipes each communicating the inflow port and the outflow port formed in different annular flow passages and protruding into the annular flow passages; a fluid feed pipe communication to the heat exchange flow passage; and a fluid discharge pipe also communicated to the heat exchange flow passage, wherein the annular flow passage is formed with annular flow passage members having the same form and the same dimensions, and each of the annular flow passage members having an annular flat surface portion, an outer peripheral surface portion and an inner peripheral surface portion.

2. The heat exchanging apparatus according to claim 1, wherein storage tanks are provided at both end portions of the heat exchange flow passage.

3. The heat exchanging apparatus according to claim 1, wherein only one end portion of the communication pipe protrudes into the annular flow passage.

4. The heat exchanging apparatus according to claim 1, wherein the plurality of annular flow passages arranged in parallel to each other are close to each other and communication holes each functioning as an inflow port and an outflow port for adjoining annular flow passages are formed.

5. The heat exchanging apparatus according to claim 1, wherein a tip of the communication pipe is arranged at a position close to an inner wall surface of the annular flow passage.

6. The heat exchanging apparatus according to claim 1, wherein a central axis of the communication pipe is substantially perpendicular to an inner wall surface of the annular flow passage.

7. A superheated steam generating apparatus comprising a steam feeder for feeding steam; a heat source for heating steam, and the heat exchanging apparatus according to claim 1, in which steam is flown for heat exchange.

* * * * *